US005586350A

United States Patent [19]

Thönnessen et al.

[11] Patent Number: 5,586,350

[45] Date of Patent: Dec. 24, 1996

[54] LOW FLAMMABILITY PILLOW

[75] Inventors: Franz Thönnessen, Bobingen; Hans H. Mühlhaus, Kriftel, both of Germany

[73] Assignee: Hoechst Aktiengesellschaft, Germany

[21] Appl. No.: 267,426

[22] Filed: Jun. 28, 1994

[30] Foreign Application Priority Data

Jun. 30, 1993 [DE] Germany ..... 9309699 U

[51] Int. Cl.[6] ..... A47G 9/02

[52] U.S. Cl. ..... 5/636; 5/645

[58] Field of Search ..... 5/636, 645, 459

[56] References Cited

U.S. PATENT DOCUMENTS

| | | | |
|---|---|---|---|
| 3,336,610 | 8/1967 | Geddings . | |
| 4,525,409 | 6/1985 | Elesh | 5/483 X |
| 4,618,531 | 10/1986 | Marcus . | |
| 4,754,513 | 7/1988 | Rinz | 5/636 X |
| 4,879,168 | 11/1989 | McCullough, Jr. et al. . | |
| 4,940,502 | 7/1990 | Marcus . | |
| 4,956,886 | 9/1990 | Sarkozi . | |
| 5,034,266 | 7/1991 | Kinlaw et al. . | |
| 5,050,256 | 9/1991 | Woodcock | 5/490 X |
| 5,141,805 | 8/1992 | Nohara et al. | 5/459 X |
| 5,321,861 | 6/1994 | Dancey et al. | 5/490 X |
| 5,458,971 | 10/1995 | Hernandez et al. | 5/636 X |

FOREIGN PATENT DOCUMENTS

| | | |
|---|---|---|
| 0265221 | 4/1988 | European Pat. Off. . |
| 0432620 | 6/1991 | European Pat. Off. . |
| 2161519 | 7/1973 | France . |

*Primary Examiner*—Michael F. Trettel
*Attorney, Agent, or Firm*—Connolly & Hutz

[57] ABSTRACT

Described is a low flammability pillow comprising a cushioning core and a cover separable therefrom, wherein the cushioning core comprises a binder-consolidated nonwoven block from 5 to 15 cm in thickness and from 700 to 3000 g/m$^2$ in basis weight comprising fibers or filaments having a linear density from 3 to 30 dtex and the cover is a pocket-shaped, closable casing comprising a textile sheet material comprising or consisting of woven or knitted fabric, the fibers and filaments of the cushioning core and of the casing comprising flame resistant polyester.

Further, a process is described for the production of the low flammability pillow.

18 Claims, 2 Drawing Sheets

LOW FLAMMABILITY PILLOW

The present invention relates to a low flammability pillow comprising a binder-consolidated nonwoven block and a cover separable from the cushioning core, comprising a pocket-like closable casing comprising a textile sheet material, the fibers and filaments of the cushioning core and of the casing comprising flame resistant polyester.

A frequent cause of fires in homes and other occupancies is that sources of ignition, such as burning cigarettes, burning candles, overheated electric installations or open flames, for example from repair work, come into contact with cushioning of the items of furniture or fitments and cause smoldering or flaming fires in this cushioning. Facilities where relatively large numbers of people congregate, such as hotels, conference centers, but also transport means such as ships, railroad compartments or airplanes, have regulations governing the flame resistance of the items of furniture or fitments used therein. Especially in the contract sector, but also domestically, fires, including smoldering fires, have serious, frequently fatal, consequences for the occupants, and it is therefore of very great interest to provide cushioning articles which are different to ignite by sources of ignition.

There has been no shortage of attempts to meet the need for low flammability cushioning materials. For instance, Japanese Patent Application 60 002 274 discloses a bulked fiber product, for example a pillow filled with a filling of thermoplastic synthetic polyester fibers, flame retardant fibers and/or polyamide fibers. At least 30% by weight of the fibers used are to be flame retardant synthetic polyester fibers with a cross-sectional circumference from 1 to 5 mm and a fiber length of not more than 10 mm. The cross-section itself is three-pointed or swastika-shaped.

However, this known material is not only relatively complicated and costly to manufacture, because of the complicated cross-sectional shape of the fibers used, but also has the serious disadvantage that, owing to the different fiber materials it contains, it is virtually impossible to recycle.

However, modern cushioning materials should not only have low flammability properties but also meet hygienic concerns; that is, they should be satisfactorily cleanable and, if necessary, sterilizable even under aggravated conditions and, in the event of their having to be replaced, should be satisfactorily disposable, preferably readily recyclable.

Especially the problem of how to reduce the cost of manufacturing low flammability cushioning materials is the concern of German Utility Model 84 29 666, which describes a flame retardant web in the form of a sheet, tile or the like, which consists of a voluminous cushioning web known per se which is combined at least on one side with a flame retardant facing web, the cushioning web and the facing web being joined together over a large area. The low flammability facing web is a needlefelt of low flammability fiber containing a proportion of hot-melt adhesive fibers and/or a proportion of synthetic fiber, the low flammability fiber consisting of polyvinyl chloride, modified polyacrylonitrile or of a copolymer. This material too is unable to meet the requirements of modern cushioning materials, in particular satisfactory cleaning, in full and because of the variety of fiber materials it contains is not recyclable and is difficult to dispose of.

The present invention, then, relates to a cushioning material which is not only inexpensive to manufacture but also easy to clean and sterilize even in use under aggravated conditions and which is simple to recycle.

The low flammability pillow of the invention comprises a cushioning core and a cover separable therefrom, wherein the cushioning core comprises a binder-consolidated nonwoven block from 5 to 15 cm, preferably from 8 to 12 cm, in thickness and from 500 to 3000 g/m$^2$, preferably from 1000 to 2000 g/m$^2$, in basis weight comprising fibers or filaments having a linear density from 3 to 50 dtex and preferably from 6 to 20 dtex. The cover is a pocket-shaped, closable casing comprising a textile sheet material comprising or consisting of woven or knitted fabric, the fibers and filaments of the cushioning core and of the casing comprising flame resistant polyester.

A further embodiment of the low flammability pillow of the invention comprises a cushioning core which in addition to the nonwoven block comprises a cylindrical nonwoven roll whose height corresponds to the width of the nonwoven block and whose diameter is from 5 to 25 cm, preferably 10–20 cm, said roll being connected detachably or nondetachably to the block. A nondetachable connection between the nonwoven roll and the nonwoven block is achieved for example in a simple manner when, in the consolidation phase of the webs, in which the consolidating binders of the nonwoven are activated—in the case of the use of a meltable binder for example by heating to above the melting point of the meltable binder—the two parts are pressed together so that a satisfactory connection is formed between the nonwoven block and the nonwoven roll at the point of contact between the two parts.

A detachable connection between the nonwoven block and the nonwoven roll can be created for example by means of a strip of a restick adhesive or of a hook-and-loop fastener applied in the contact region. In a further variant of this embodiment, the nonwoven block and the nonwoven roll of the cushioning core each have separate covers and the two parts are connected together detachably. In this case too the detachable connection can be created by means of a restick adhesive applied in strip form or preferably by means of a hook-and-loop fastener.

In this preferred embodiment, the low flammability pillow of the invention is particularly suitable for supporting the neck (neckroll). In this embodiment it can therefore be used with particular advantage in particular in the orthopedic sector. Preferably the nonwoven roll of the cushioning core comprises a rolled-up sheetlike nonwoven having a basis weight from 200 to 800 g/m$^2$, which is rolled up in the unconsolidated state and then consolidated by activation of the binder and so stabilized in the roll form.

Figure 1:
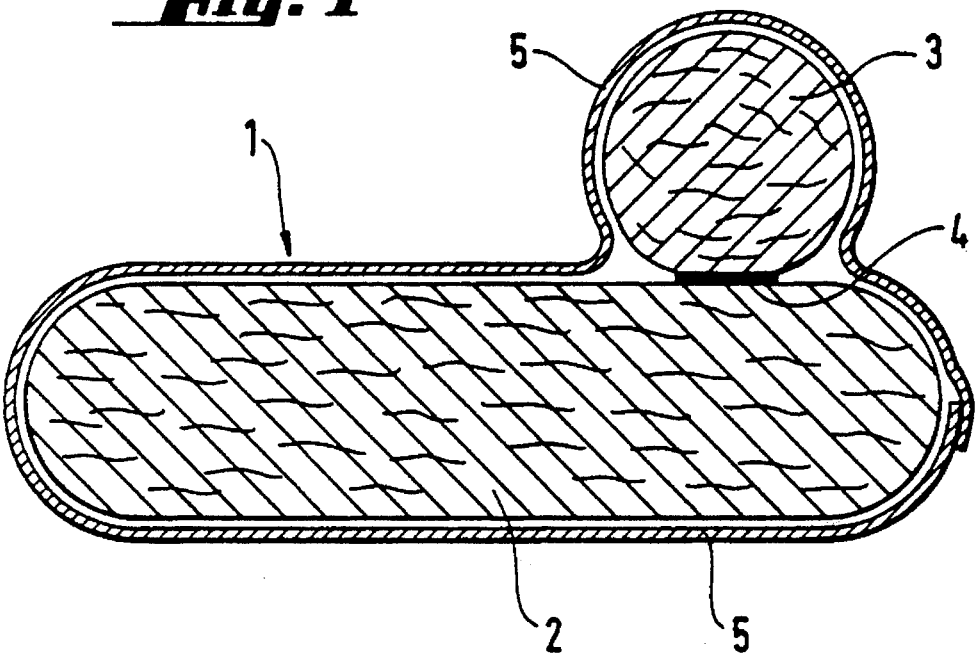
FIG. 1 is a diagrammatic section through a pillow (1) according to the invention, comprising the nonwoven block (2), the nonwoven roll (3), the connecting element (4), which provides the detachable connection between the nonwoven block (2) and the nonwoven roll (3), and the conjoint cover (5).
Figure 2:
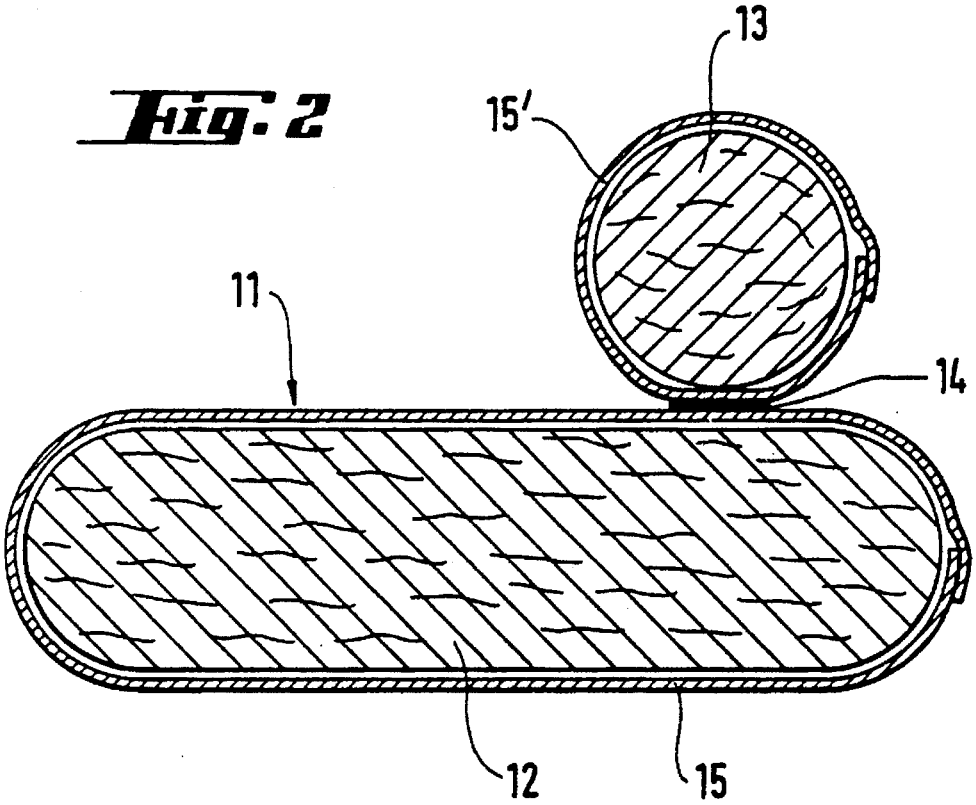
FIG. 2 is a diagrammatic section through another embodiment of the pillow (11) of the invention, comprising the nonwoven block (12), the nonwoven roll (13), the covers (15) and (15') for the nonwoven block (12) and the nonwoven roll (13), and the connecting element (14) which provides the detachable connection between the covered parts of the pillow.
Figure 3:
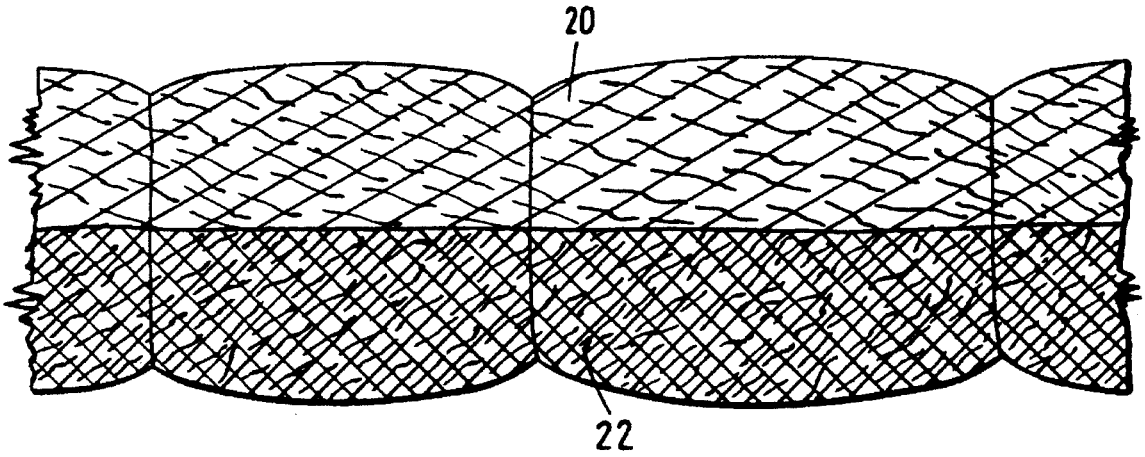
FIG. 3 is a diagrammatic elevational view of a textile sheet material of the present invention including a nonwoven batt (20) and a woven or knitted fabric (22).
Figure 4:
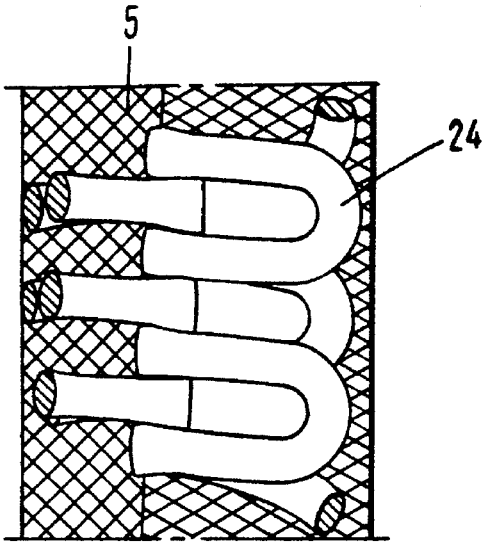
FIG. 4 is a diagrammatic elevational view illustrating a closure for cover (5) in the form of a zip or hook and loop fastener (24).

The nonwoven block and the nonwoven roll of the low flammability pillow of the invention may comprise continuous filaments or staple fibers. Advantageously the linear density of the fiber material of the nonwoven roll is chosen to be higher than that of the fiber material of the nonwoven block. This results in a higher compressive strength for the roll and so in particularly good support for the neck.

It is of course also possible to make the nonwoven block and the nonwoven roll from different fiber materials; in particular, they may have different fiber lengths. For example, the nonwoven block may be composed of continuous filament fibers and the nonwoven roll of staple fibers, or vice versa. The staple length of the staple fibers used for the nonwoven block and/or nonwoven roll is advantageously within the range from 30 to 150 mm, preferably from 40 to 100 mm.

Although the binders used for the pillow of the invention can be binder dispersions which bring about the consolidation of the nonwoven through evaporation of the liquid continuous phase, the use of meltable binders is preferred.

Preferably, therefore, the cushioning core, not only the nonwoven block but also the nonwoven roll, comprises meltable-binder-consolidated nonwoven. The meltable binder is particularly advantageously introduced into the nonwoven in the form of fibers (binding fibers). Depending on the desired degree of consolidation of the web, the weight proportion of the binder ranges from 5 to 35% by weight, preferably from 10 to 25% by weight, of the total nonwoven weight (including binder). From the aspect of the desired recyclability, it is particularly preferable for the meltable binder to be a modified polyester whose melting point is at least 10° C., preferably 20° C., below the melting point of the load-bearing nonwoven fibers.

If the meltable binder is, as is preferred, used in fiber form, it may be in the form of separate binding fibers or it may be part of a two-component fiber, of the side-by-side or core-sheath type, in which case the sheath or one of the sides of the bicomponent fiber comprises the meltable binder. In the interest of ease of disposal it is particularly preferable for not only the load-bearing fibers but also the binding fibers of the cushioning core to comprise polyesters having different melting points. Within the above-specified limits, the binder content is preferably chosen so that the cushioning core has a relatively firm hand.

The cover of the flame retardant pillow of the invention may comprise a fabric woven or knitted from continuous filament yarn or from staple fiber yarn. Woven or knitted fabrics for the cover advantageously have a basis weight from 100 to 300 g/m$^2$. Woven fabrics for this purpose advantageously have a plain or satin/sateen weave, which confers particularly pleasant skin contact. Knitted fabric is for the same reason preferably knitted to a single face.

Particular preference is given to a low flammability pillow of the invention wherein the cover comprises an at least two-layered combination of a nonwoven having a basis weight from 50 to 300 g/m$^2$ with a woven or knitted fabric having a basis weight from 100 to 300 g/m$^2$, which are connected together, preferably by quilting. Of particular advantage is a cover comprising such a nonwoven faced and quilted on both sides with woven or knitted fabric. The advantage of such a three-layered construction of the cover is that such a multi-layered cover can serve as a thin headrest even without the cushioning core.

In the interest of a particularly skin friendly and textile hand of the low flammability pillow of the invention it is preferable for the fibers comprising the woven or knitted fabric of the cover to be textured multifilament yarns or else staple fiber yarns. The texturing may have been effected by any conventional process, in particular by air jet texturing or false twist texturing. The linear density of the yarns present in the cover is advantageously within the range from 60 to 200 dtex, and multifilament yarns generally contain from 30 to 150 individual filaments.

Suitable polyesters for the fiber materials—fiber materials for the purposes of this invention being not only staple fibers but also continuous filament fibers—of the cushioning core and of the cover are spinnable grades which have been modified or finished to be flame resistant and which consist predominantly of building blocks derived from aromatic dicarboxylic acids and from aliphatic diols. Widely used aromatic dicarboxylic acid building blocks are the bivalent radicals of benzenedicarboxylic acids, in particular of terephthalic acid and of isophthalic acid; widely used diols have 2–4 carbon atoms, and ethylene glycol is particularly suitable. Modified polyesters preferably contain at least 85 mol % of ethylene terephthalate units. The remaining 15 mol % are then made up of dicarboxylic acid units and glycol units, which act as modifiers and which make it possible for the person skilled in the art to influence the physical and chemical properties of the filament products in a specific manner. Examples of such dicarboxylic acid units are radicals of isophthalic acid or of aliphatic dicarboxylic acids such as glutaric acid, adipic acid and sebacic acid; examples of modifying diol radicals are those of longer diols, for example of propanediol or butanediol, of di- or triethylene glycol or, if present in a small amount, of polyglycol having a molecular weight of about 500–2000. Particular preference is given to polyesters which contain at least 95 mol % of ethylene terephthalate units, in particular to polyesters made of unmodified PET.

The modifying of these polyester materials to render them flame resistant is effected by additions of halogen compounds, in particular bromine compounds, or, particularly advantageously, by the presence of from 0.1 to 20, preferably from 2 to 12, % by weight of phosphorus compounds which have been cocondensed into the polyester chain. Particularly preferred flame resistant polyesters for the fiber materials of the low flammability pillows of the invention are those which contain, cocondensed into the chain, building groups of the formula

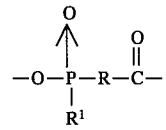

(I)

where R is alkylene or polymethylene of 2 to 6 carbon atoms or phenyl and $R^1$ is alkyl of 1 to 6 carbon atoms, aryl or aralkyl.

The preferred meanings for the symbols in the formula I are ethylene for R and methyl, ethyl, phenyl or o-, m- or p-methylphenyl, in particular methyl, for $R^1$.

The polyesters present in the pillows of the invention advantageously have a molecular weight corresponding to an intrinsic viscosity (IV), measured in a solution of 1 g of polymer in 100 ml of dichloroacetic acid at 25° C., of from 0.5 to 1.4 dl/g.

In a further preferred embodiment of the low flammability pillow of the invention, the fiber materials used for producing the cushioning core and the cover are chosen in respect of the polyester composition and in respect of the spinning conditions so that the cushioning core is sterilizable and the cover can be boil-washed.

It is further particularly advantageous for the cover of the low flammability pillow to be constructed closable by means of a zip fastener (zipper) or a hook-and-loop fastener. In the interest of satisfactory recyclability of the pillow of the invention (single material constitution) it is preferable for the zip or hook-and-loop fastener of the pillow cover to comprise polyester monofilaments. It is particularly preferable for the monofilaments of the zip or hook-and-loop fastener to comprise flame resistant polyester like the rest of the fiber materials of the pillow.

The embodiment example which follows illustrates the production of a low flammability pillow of this invention. All the flame resistant polyester fibers used in the Example were made of polyethylene terephthalate rendered flame resistant by incorporation of building groups of the above-indicated formula I ((R) TREVIRA CS—fiber materials from Hoechst AG).

EXAMPLE a) Nonwoven block

A worker-and-stripper type carding machine was used to process a mixture of 80% by weight of a 17 dtex polyethylene terephthalate staple fiber which had a staple length of 80 mm and had been rendered flame resistant by incorporation of building blocks of the formula I and 20% by weight of a bicomponent fiber of the core-sheath type with a core of flame resistant polyethylene terephthalate and a sheath of poly(ethylene terephthalate isophthalate) with a core-sheath weight ratio of 50:50, a linear density of 4.4 dtex and a staple length of 50 mm into a web having a basis weight of 1500 g/m$^2$. The web was compacted to a level from 8 to 10 cm and bonded at 160° C. in a hot air oven.

b) Neckroll

The same fiber mixture was carded on the same machine to produce a 400 g/m$^2$ web which was then preconsolidated by light needling. The resulting web, still to be binder-consolidated, was rolled up into a roll 15 cm in diameter and set in that form at 160° C. in the hot air oven. The resulting cushioning cores for pillow and neckroll were of low flammability, recyclable, washable and sterilizable and had a relatively firm hand. The firmness of the hand of these core materials, their compressive strength and their ability to recover can be varied and adjusted as desired through the choice of fiber linear density, binder content, setting temperature and air supply.

c) Cover

The above-produced nonwoven block and the nonwoven roll had sewn for them separate covers which are equipped at the open sides with zippers made of polyester wire. For this was used a three-layered textile sheet material comprising a fiber web 200 g/m$^2$ in basis weight comprising flame resistant polyethylene terephthalate fibers and faced on both sides with a woven fabric (180 g/m$^2$) made of staple fiber yarn (fiber linear density 1.7 dtex) of flame resistant polyethylene terephthalate. The two covers are provided at suitable places with hook-and-loop fastener strips of flame resistant polyester wire, so that the neckroll can be connected detachably to the pillow at a suitable position.

The covers are slipped over the nonwoven block and the nonwoven roll and closed with the zippers. The resulting elements of the pillow are then pressed together at the hook-and-loop fastening strips to combine them into a pillow of this invention.

What is claimed is:

1. A low flammability pillow comprising a cushioning core and a cover separable therefrom, wherein the cushioning core comprises a binder-consolidated nonwoven block from 5 to 15 cm in thickness and from 500 to 3000 g/m$^2$ in basis weight comprising fibers or filaments having a linear density from 3 to 50 dtex and the cover is a pocket-shaped, closable casing comprising a textile sheet material comprising woven or knitted fabric, the fibers and filaments of the cushioning core and of the casing comprising flame resistant polyester, and wherein the flame resistant polyester contains cocondensed structural units of the formula I

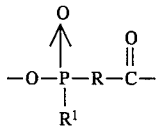

(I)

where R is alkylene or polymethylene of 2 to 6 carbon atoms or phenyl and $R^1$ is alkyl of 1 to 6 carbon atoms, aryl or aralkyl.

2. The low flammability pillow of claim 1, wherein the cover is closable by means of a zip or hook-and-loop fastener.

3. The low flammability pillow of claim 2, wherein the zip or hook-and-loop fastener is made of polyester wire, in particular of flame resistant polyester wire.

4. The low flammability pillow of claim 1, wherein the cushioning core comprises a binder-consolidated nonwoven block from 8 to 12 cm in thickness.

5. The low flammability pillow of claim 1, wherein the cushioning core in addition to the nonwoven block comprises a cylindrical nonwoven roll whose height corresponds to the width of the nonwoven block and whose diameter is from 5 to 20 cm, said roll being connected detachably or nondetachably to the block.

6. The low flammability pillow of claim 1, wherein the nonwoven block and the cylindrical nonwoven roll of the cushioning core each have separate covers and the two parts are connected together detachably.

7. The low flammability pillow of claim 1, wherein the cushioning core is sterilizable.

8. The low flammability pillow of claim 1, wherein the cushioning core comprises a meltable-binder-consolidated nonwoven batt.

9. The low flammability pillow of claim 8, wherein the meltable-binder consolidated nonwoven batt includes a meltable binder introduced into the nonwoven batt in fiber form.

10. The low flammability pillow of claim 8, wherein the meltable-binder consolidated nonwoven batt includes a meltable binder introduced into the nonwoven batt in the form of bicomponent fibers composed of two polyesters having different melting points.

11. The low flammability pillow of claim 1, wherein the cover can be boil-washed.

12. The low flammability pillow of claim 1, wherein the fibers of the cushioning core and of the cover comprise flame resistant polyethylene terephthalate.

13. A low flammability pillow comprising a cushioning core and a cover separable therefrom, wherein the cushioning core comprises a binder-consolidated nonwoven block from 5 to 50 cm in thickness and from 500 to 3000 g/m$^2$ in basis weight comprising fibers or filaments having a linear density from 3 to 50 dtex and the cover is a pocket-shaped, closable casing comprising a textile sheet material comprising woven or knitted fabric, the fibers and filaments of the cushioning core and of the casing comprising flame resistant polyester, and wherein the textile sheet material of the cover comprises an at least two-layered combination of a nonwoven batt having a basis weight from 50 to 300 g/m$^2$ with a woven or knitted fabric having a basis weight from 100 to 300 g/m$^2$, which are connected together.

14. The low flammability pillow of claim 13, wherein the nonwoven batt and the woven or knitted fabric are connected together by quilting.

15. A low flammability pillow comprising a cushioning core and a cover separable therefrom, wherein the cushioning core comprises a binder-consolidated nonwoven block from 5 to 15 cm in thickness and from 500 to 3000 g/m$^2$ in basis weight comprising fibers or filaments having a linear density from 3 to 50 dtex and the cover is a pocket-shaped, closable casing comprising a textile sheet material comprising woven or knitted fabric, the fibers and filaments of the cushioning core and of the casing comprising flame resistant polyester, and wherein the flame resistant polyester contains halogen compounds condensed into the polyester.

16. The low flammability pillow of claim 15, wherein the halogen compounds comprise bromine compounds.

17. A low flammability pillow comprising a cushioning core and a cover separable therefrom, wherein the cushioning core comprises a binder-consolidated nonwoven block from 5 to 15 cm in thickness and from 500 to 3000 g/m$^2$ in basis weight comprising fibers or filaments having a linear density from 3 to 50 dtex and the cover is a pocket-shaped, closable casing comprising a textile sheet material comprising woven or knitted fabric, the fibers and filaments of the cushioning core and of the casing comprising flame resistant polyester, and wherein the flame resistant polyester contains 0.1 to 20% by weight of phosphorus compounds condensed into the polyester.

18. The low flammability pillow of claim 17, wherein the phosphorous compounds are present in an amount from 2 to 12% by weight.

* * * * *